United States Patent [19]

Rosenwinkel et al.

[11] Patent Number: 4,863,172

[45] Date of Patent: Sep. 5, 1989

[54] FRONT AND BACK GRIDS COMPRISING PUZZLE WITH MOVABLE SQUARES

[75] Inventors: Donald A. Rosenwinkel, Oak Park; John V. Zaruba, Chicago; Wayne A. Kuna, River Forest, all of Ill.

[73] Assignee: Marvin Glass & Associates, Chicago, Ill.

[21] Appl. No.: 152,441

[22] Filed: Feb. 5, 1988

[51] Int. Cl.[4] ..... A63F 9/08

[52] U.S. Cl. ..... 273/153 S; 273/153 R; 273/237

[58] Field of Search ..... 273/153 S, 153 R, 237, 273/238, 157 R

[56] References Cited

U.S. PATENT DOCUMENTS

| | | | |
|---|---|---|---|
| 2,779,598 | 1/1957 | Steinhardt | 273/153 S |
| 4,323,243 | 4/1982 | Hanson et al. | 273/153 S |
| 4,333,652 | 6/1982 | Clancy | 273/153 S |
| 4,540,177 | 9/1985 | Horvath | 273/153 S |
| 4,593,907 | 6/1986 | Abu-Shumays et al. | 273/153 S |

FOREIGN PATENT DOCUMENTS

| | | |
|---|---|---|
| 0074308 | 3/1983 | European Pat. Off. . |
| 84/02851 | 1/1983 | PCT Int'l Appl. . |

*Primary Examiner*—Leo P. Picard
*Attorney, Agent, or Firm*—John S. Pacocha

[57] ABSTRACT

A puzzle in which alphabet letters or other graphics are displayed in movable squares forming a grid on a front side of the puzzle. On the back side of the puzzle is another grid of movable squares containing alphabet letters or other graphics. Each square is a part of each of two mutually transverse, continuous bands. One band comprises aligned front side and back side rows while the other transverse band comprises aligned front side and back side columns. The relationship of each square in the puzzle may be changed with respect to every other square. As squares are moved out of the front side grid, they wrap around, out of sight, and change the grid of squares on the back side while bringing an out of sight square into the front side grid. In one electronic version of the puzzle, movement of a square is effected by touching the front side square to be moved and then touching the position on the front side row or column to which the square is to be moved. Grids in a mechanical version have moveable pieces carried in transverse intersecting slots formed by parts mounted on posts and spaced from a core.

10 Claims, 6 Drawing Sheets

Fig 2A
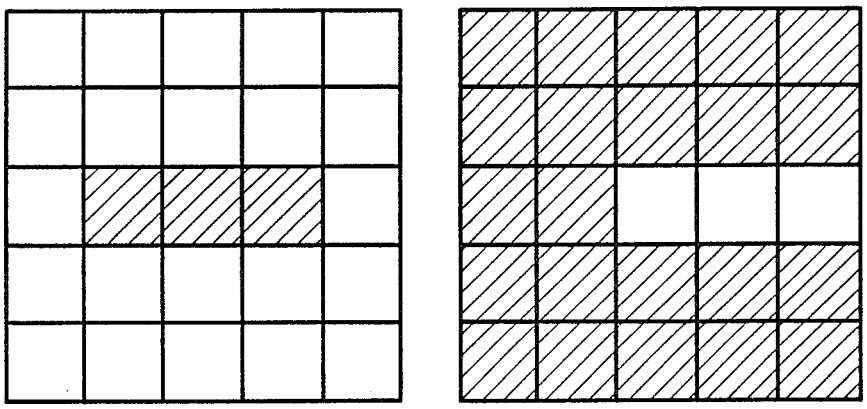
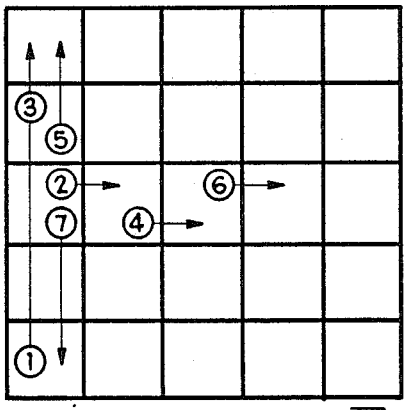
Fig 2B
Fig 5A
| | | | | |
|---|---|---|---|---|
| A | B | C | D | E |
| F | G | H | I | J |
| K | L | M | N | O |
| P | Q | R | S | T |
| U | V | W | X | Y |
| | | | | |
|---|---|---|---|---|
| M | A | R | F | N |
| E | B | O | E | A |
| P | U | Z | L | E |
| D | I | O | C | T |
| G | L | A | S | H |
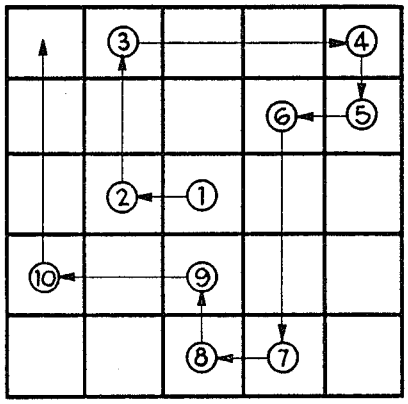
Fig 5B

Fig 4A

40

| | | | | |
|---|---|---|---|---|
| Q | Z | E | N | O |
| G | B | G | C | O |
| U | M | A | H | H |
| O | E | M | T | X |
| K | L | V | L | Y |

44

42

| | | | | |
|---|---|---|---|---|
| R | U | P | D | A |
| B | C | I | A | N |
| W | T | D | J | R |
| I | F | A | F | E |
| L | P | S | E | S |

48

46

Fig 4B

| | | | | |
|---|---|---|---|---|
| | | | | |
| | | | | |
| H | E | A | V | Y |
| | | | | |
| | | | | |

Fig 4C

| | | | | |
|---|---|---|---|---|
| | P | | | |
| G | A | M | E | S |
| | R | | | |
| | T | | | |
| | Y | | | |

Fig 4D

| | | | | |
|---|---|---|---|---|
| | | | | |
| P | A | P | E | R |
| M | O | N | E | Y |
| | | | | |
| | | | | |

Fig 4E

| | | | | |
|---|---|---|---|---|
| W | H | I | T | E |
| H | O | U | S | E |
| F | A | N | C | Y |
| L | A | T | E | R |
| T | R | I | C | K |

Fig 4F

| | | | | |
|---|---|---|---|---|
| | | R | | |
| | | A | | |
| S | H | I | N | E |
| | | N | | |
| | | Y | | |

| | | | | |
|---|---|---|---|---|
| | | S | | |
| | | T | | |
| C | L | O | U | D |
| | | R | | |
| | | M | | |

Fig 4G

| | | | | |
|---|---|---|---|---|
| | | | | |
| | | | | |
| E | L | E | C | T |
| | | | | |
| | | | | |

| | | | | |
|---|---|---|---|---|
| | | | | |
| | | | | |
| C | I | N | O | R |
| | | | | |
| | | | | |

Fig 9
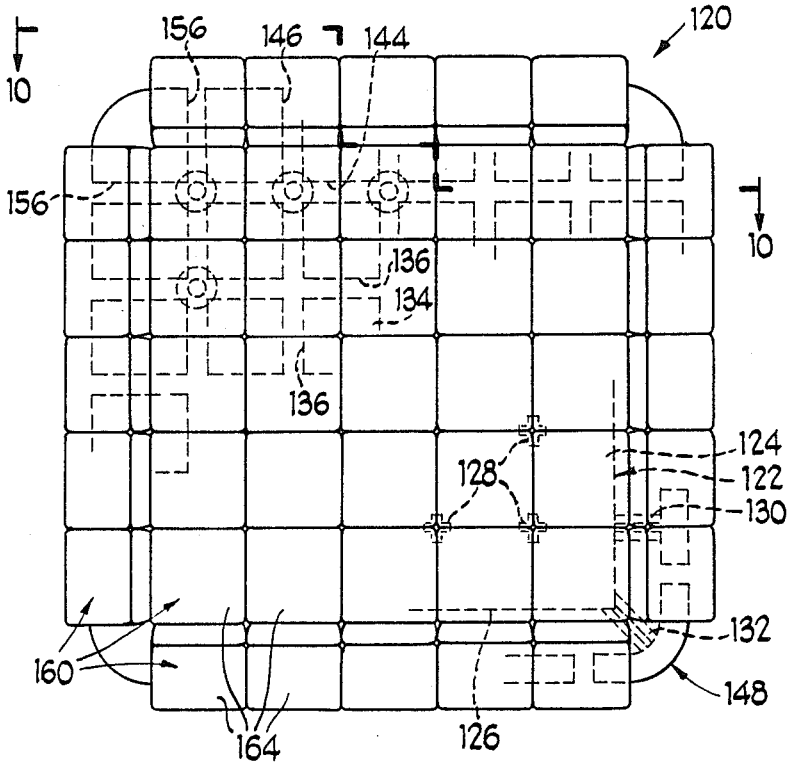
Fig 10
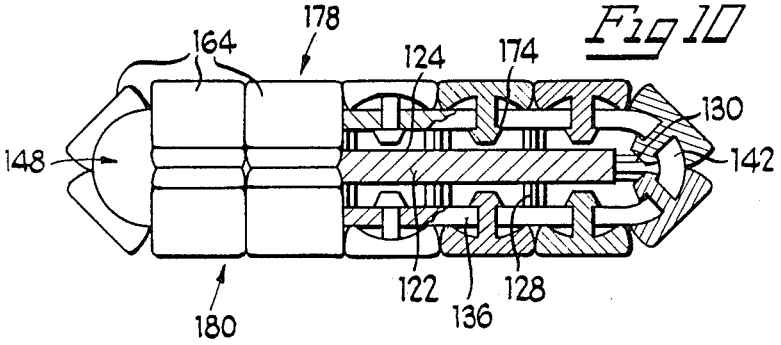
Fig 12
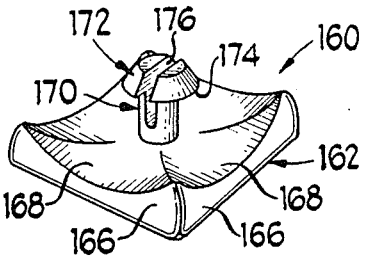
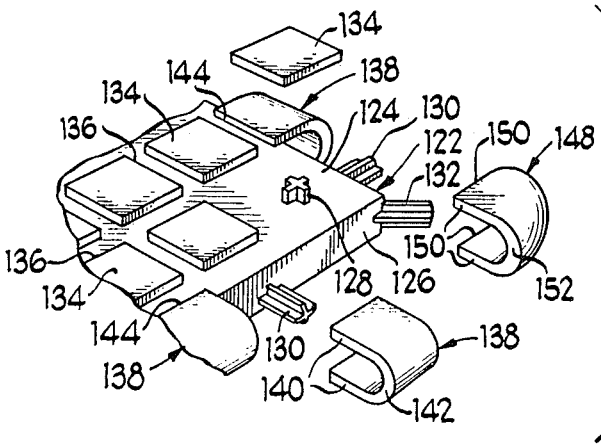
Fig 11

FRONT AND BACK GRIDS COMPRISING PUZZLE WITH MOVABLE SQUARES

BACKGROUND OF THE INVENTION

1. Field of the Invention

This invention relates generally to games and more particularly to a puzzle solving game.

2. Background Art

Manipulative puzzles such as the well known RUBIK'S CUBE that had been commercially distributed by Ideal Corporation have been popular pastimes for children and adults alike. In the RUBIK'S CUBE puzzle, three by three grids of small cubes formed a large cube with different colors on each of the six faces of the large cube. Only certain predetermined faces of the small cubes were exposed and each exposed face of each small cube was a different one of the six colors. The center cube of each three by three grid face has a fixed relationship to the center cube on the opposite face and the three exposed faces of a corner cube always bore the same relationship to each other no matter what the rotational position of that corner cube. Other examples of prior art manipulative puzzles are found in Hansen, et al. U.S. Pat. No. 4,373,729 issued Feb. 15, 1983; Yokoi U.S. Pat. No. 4,402,510 issued Sept. 6, 1983; Wiggs, et al. U.S. Pat. No. 4,553,754 issued Nov. 19, 1985; Sherman, Jr. et al., U.S. Pat. No. 4,557,484 issued Dec. 10, 1985 and Rubik U.S. Pat. No. 4,685,680 issued Aug. 11, 1987. There remains a need, however, for a manipulative puzzle solving game that provides a variety of puzzles for the player to solve.

SUMMARY OF THE INVENTION

This invention is concerned with providing a manipulative puzzle in which movable squares form a grid on both the front and back sides of the puzzle. The relationship of each square in the puzzle may be changed with respect to every other square. Each square is part of each of two mutually transverse, continuous bands. One of the bands comprises aligned rows in the grids on the front side and the back side while the other, transverse band comprises aligned columns in the front side and back side grids. As squares are moved out of the front side grid, they wrap around, out of sight, and change the grid of squares on the back side, while bringing an out of sight square into the front side grid. In an electronic version of the puzzle, movement of a square is effected by touching the front side square to be moved and then touching the position in the same row or column on the front side to which the square is to be moved. Alternatively, movement of the squares may be accomplished by switches for each row and column, a joystick, or a computer keyboard. A mechanical version of the puzzle includes a core supporting a plurality of spaced apart parts defining one set of substantially parallel slots plus a second set of substantially parallel slots that are substantially transverse to the slots of the first set. Movable pieces are mounted for sliding movement with a head atop the parts, a body extending through the slots and a foot on the bottom end of the body engaging the underside of the parts. The underside of the head is cross vaulted and cooperates with curved end pieces that are disposed between the front and back sides.

BRIEF DESCRIPTION OF THE DRAWINGS

For a better understanding of the present invention, reference may be had to the accompanying drawings in which:

FIGS. 2A–2B are schematic views of another puzzle and its solution;

FIGS. 4A–4G are schematic views of an alternative embodiment and various puzzles that may be solved with the alternative embodiment;

FIGS. 5A–5B are schematic views of a puzzle solved from the embodiment illustrated in FIG. 4A and a diagram solution of the puzzle;

FIG. 9 is a front elevational view of a mechanical embodiment of the present invention;

FIG. 10 is an end elevational view, partially in section, taken generally along along 10—10 of FIG. 9;

FIG. 11 is a fragmentary exploded view; and

FIG. 12 is an enlarged scale, bottom perspective view of one of the movable pieces shown in FIGS. 9 and 10.

DETAILED DESCRIPTION OF THE PREFERRED EMBODIMENT

Figure 1A:
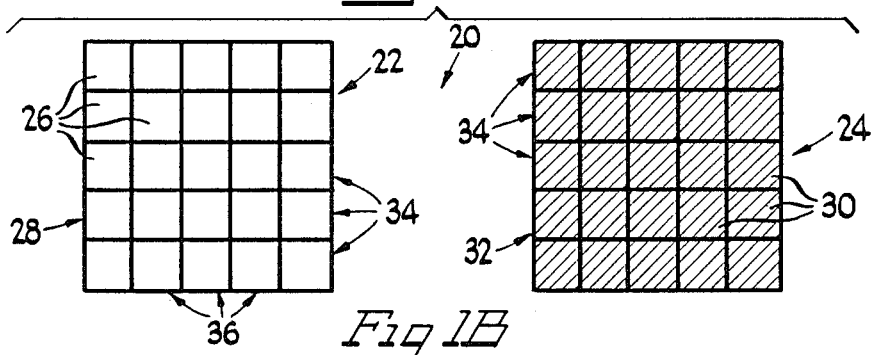
FIGS. 1A–1E are schematic views of an embodiment of the present invention and illustrate the four step solution of a simple puzzle.

Referring now to the drawings in which like parts are designated by like reference numerals throughout the several views, FIG. 1A shows a game 20 having a front side 22 and a back side 24. On front side 22 there are conveniently twenty-five movable squares 26 forming a five by five grid 28. Similarly, on back side 24 there are conveniently twenty-five movable squares 30 forming a five by five grid 32. The number of squares forming the grid on either side can be the square of any numeral as long as the size of both grids is the same. By the same token, the grid may be rectangular rather than square. However, as the size of the grid increases, the expense of the puzzle game as well as the difficulty of solving the puzzles becomes greater.

In FIG. 1A, all twenty-five squares 26 on the front side are illustrated as white while all twenty-five squares 30 on the back side are lined for the color brown. The colors white and brown were chosen solely for ease of illustration in this application. It will be appreciated by those skilled in the art that the squares may be distinguished from each other by any contrasting colors or by other suitable graphics. For ease and economy of manufacture, particularly in electronic embodiments of the puzzle, one set of twenty-five squares would probably be light or white and the other set of twenty-five squares would be dark or black. Similarly, it does not make any difference whether squares 26 on the front side are white and squares 30 on the back side are brown, or vice versa, as long as the two sets of squares are readily distinguishable. A greater number of puzzles, including more difficult puzzles, may be provided by distinguishing one, such as the central square, or more squares from the others by another color or other graphics.

Each square 26 or 30 is part of each of two mutually transverse, continuous bands and is movable with respect to every other square 26 and 30. One of such bands forms aligned rows 34 in both the front side and back side grids. The other mutually transverse band forms aligned columns 36 in both the front and back side grids.

The changeability of the relationship of each square with respect to every other square in the front and back side grids is illustrated by the solution, shown schematically in FIGS. 1B–1E, of a relatively simple puzzle in which the colors of the center squares on each of the opposed front and back sides are reversed. In each of FIGS. 1B–1E, the back side is illustrated as if it were an x-ray view seen through the front side rather than physically turning the puzzle around to view the back side. At the start, the game is in the position illustrated in FIG. 1A in which all of the squares in the front side grid are white and all of the squares in the back side grid are brown.

Figure 1B:
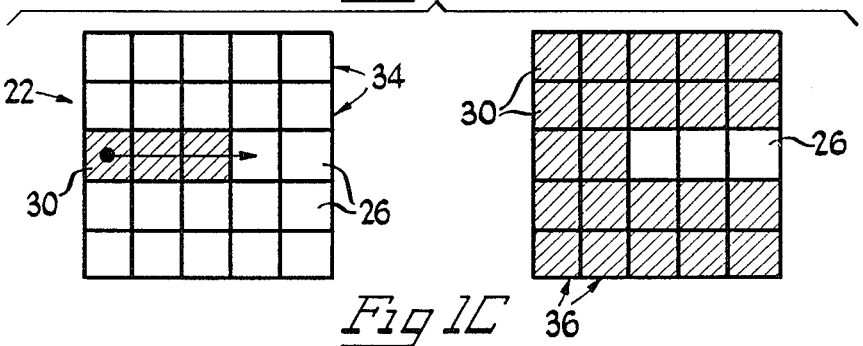
Figure 1C:
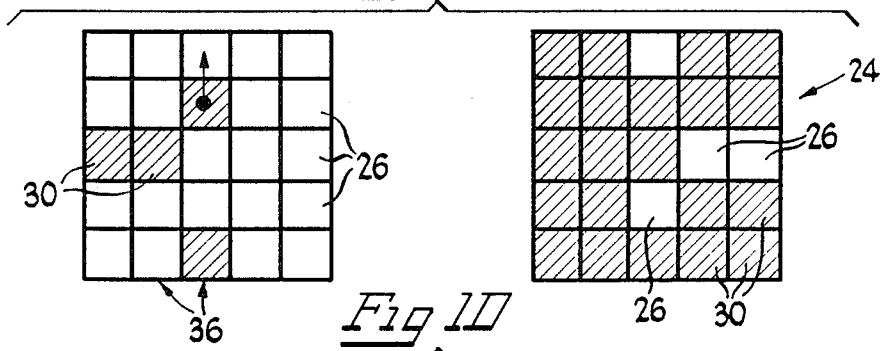
Figure 1D:
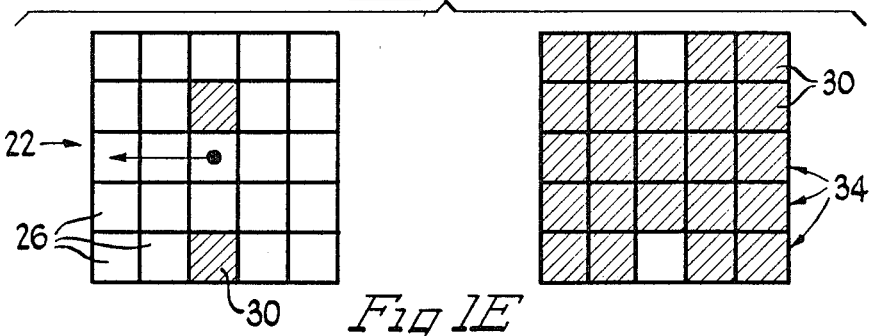
Figure 1E:
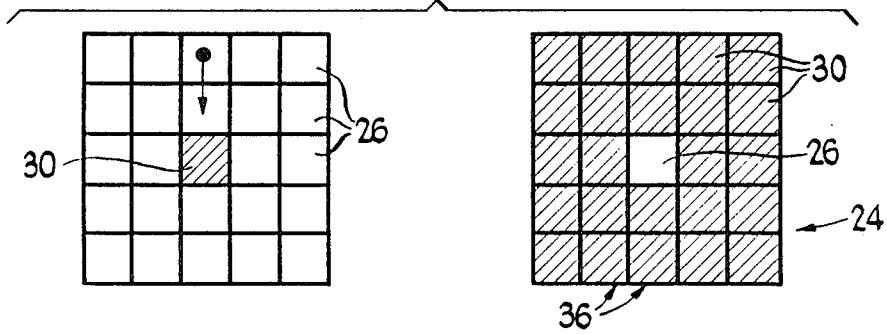

For the first step in solving the puzzle, the leftmost white square 26 in the central row 34 is moved four squares to the right as illustrated by the arrow in FIG. 1B. As a result of the first move, three white squares 26 are moved from the central row of the front side grid, around, out of sight, to the central row of the back side grid while three brown squares 30 are brought around into the central row of the front side grid. Second, the central column on the front side grid is moved one square upwardly as indicated by the arrow in FIG. 1C. After the second step, the pattern of the front and back side grids is as illustrated in FIG. 1C. The third step requires the movement of a square in the central row of the front side grid two squares to the left as illustrated by the arrow in FIG. 1D, to produce the pattern on the front and back side grids illustrated in FIG. 1D. Finally, the fourth step moves a square in the front side grid central column down one square. As a result of the four moves, the initial central white square on the front side grid has been replaced with a brown square 30 from the back side grid other than the initial central brown square. At the same time, the initial central brown square on the opposite back side grid has been replaced with a white square 26 from the front side grid other than the initial central white square.

Solution of the front side of the puzzle illustrated in FIGS. 1A–1E simultaneously provides solution of both the front and the negative image on the back side. The present invention may be used to solve for puzzles on only the front side without regard to the resulting back side grid pattern. One example of such a front side grid only puzzle is illustrated in FIGS. 2A and 2B. On the front side of the solved puzzle are three brown squares 30 in the central three positions of the central row. However, the white squares on the back side occupy the center and the next two positions to the right in the central row, as viewed in the see through, x-ray view of the back side. A six step solution for the puzzle of FIG. 2A is diagrammatically illustrated in FIG. 2B with each step sequentially indicated by an encircled numeral 1–6 and the length of each step or move indicated by the length of the arrow emanating from the encircled numeral.

Figure 3A:
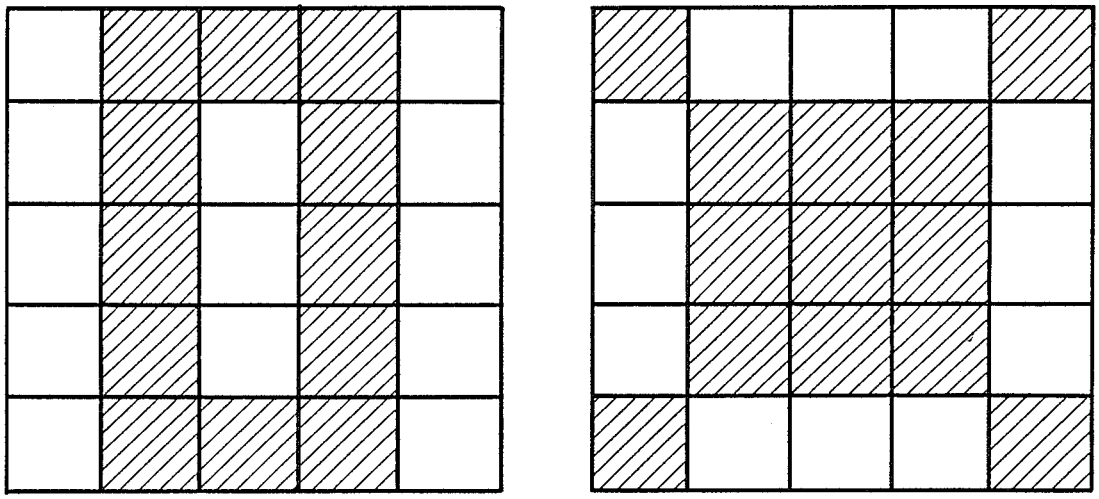
FIGS. 3A–3C are schematic views of a more difficult puzzle.
Figure 3B:
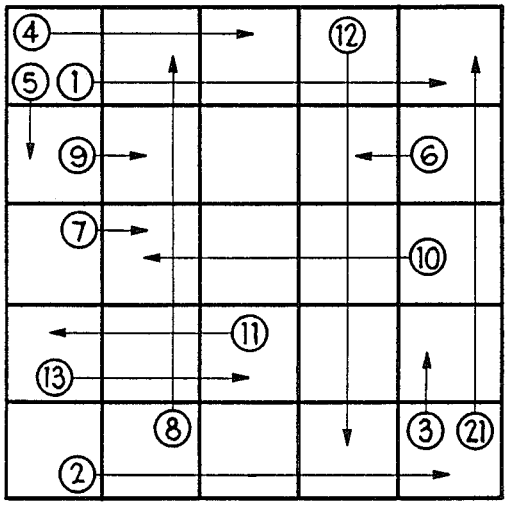
Figure 3C:
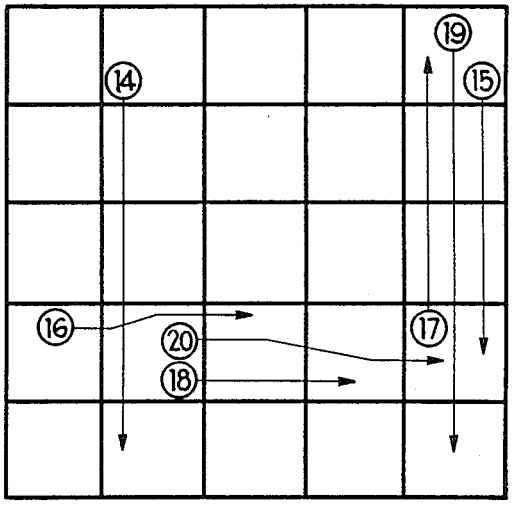

More difficult puzzles involving the simultaneous solution for different patterns on both the front and back side are also available with the present invention. An example of such a puzzle is illustrated in FIGS. 3A–3C. As with the previously described puzzles, this puzzle starts with all white squares 26 in the front side grid and brown squares 30 in the back side grid. The solution requires that the squares be manipulated to obtain a letter "O", or numeral "0", formed by brown squares 30 on the front side and a pattern on the back side grid comprising a central three by three brown square grid with each outside corner of the five by five grid also being a brown square 30. Twenty-one moves for achieving the solution are diagrammatically indicated in FIGS. 3B and 3C showing all of the moves to be made on the front side grid using the same conventions as in FIG. 2B.

For an alternative game 40, movable alphabet bearing squares 42 form front side grid 44 and movable alphabet bearing squares 46 form back side grid 48. With each of squares 42 and 46 bearing the respective alphabet letters shown in FIG. 4A, the game may be manipulated to solve various word puzzles including the examples illustrated in FIGS. 4B–4G. As illustrated in FIG. 4B, game 40 may be solved to spell a single five letter word in a row on the front side. Alternatively, the single five letter word may be spelled in a front side column.

Somewhat more difficult puzzles require the spelling of two, five letter, intersecting words as illustrated in FIG. 4C or two, or more, words in adjacent rows as illustrated in FIG. 4D, or in adjacent columns. The intersecting words, or the words in adjacent rows or columns, may be required to be related such as "party games" and "paper money" although the use of unrelated words may be permitted for relatively easier puzzles. For an even more difficult solution, all five rows or columns of the front side grid may be required to be filled with five letter words as illustrated in FIG. 4E.

Requiring simultaneous solution of both the front and back side grids presents even greater difficulty. FIG. 4F illustrates an example of such a solution by two five letter words in the center row and column in each of the front and back side grids. A further variation of play may require the spelling of a ten letter word starting on the front side and continuing around on the back side. Thus, for example, FIG. 4G illustrates the spelling of the word "electronic" with the back side being shown in an x-ray or see through view so that the last five letters of the word appear right to left instead of left to right. Other ten letter words such as "stoplights" and "Washington" may also be formed by rearranging the letters shown in FIG. 4A.

With game 40 in the starting position illustrated in FIG. 4A, the letters of the alphabet "A" through "Y" may be arranged in ten moves or steps into horizontal rows on the front side grid with "Z" centered on the back side grid as illustrated in FIG. 5A. The solution for this alphabet puzzle is diagrammatically indicated in FIG. 5B. All ten steps involve movement of the letter "A" that starts in the center square on the front side grid without ever moving it off of the front side grid.

Game 40 with alphabet squares 42 and 46, as shown in FIG. 4A, may be used in a multiple player crossword type game. At the onset, the arrangement of letter squares is scrambled, such as by permitting each player five or so moves to scramble the letters. The starting player spells a five letter word either in a row or column using the fewest possible moves or steps. Then, the next player spells a five letter word at right angles to the first word, again using the fewest number of moves. Play continues, disregarding every previous word other than the immediately last formed word, with a new five letter word having to be spelled at right angles to the immediately last formed word, but not in the same row or column as the penultimately formed word.

Once a player's moves exceed a predetermined number, as for example fifty, the round of play is over and the player having used the least number of moves wins the round. A time limit may be established and, if a player is not able to form a word within the time limit, the player's turn is over and a number of points, such as ten, are added to that player's score. In the event of such a forfeit turn, the next player must then form a word crossing the same word that the previous, forfeiting player was using. An additional rule may prohibit the use of any word that has been previously spelled during the round.

Figure 6:
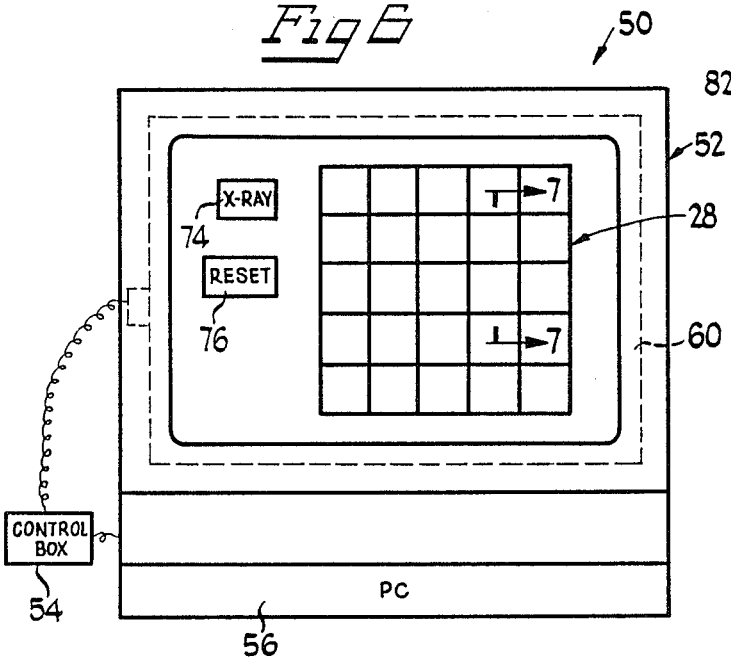
FIG. 6 is a front elevational view of an electronic embodiment of the present invention.
Figure 7:
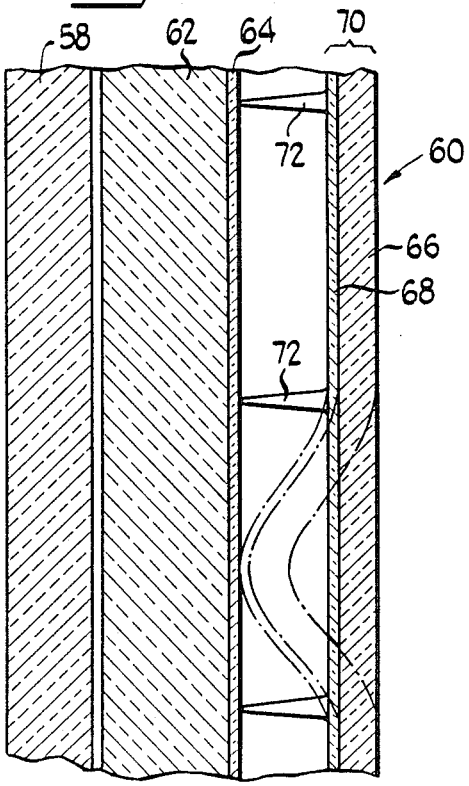
FIG. 7 is an enlarged, fragmentary sectional view taken generally along line 7—7 of FIG. 6.

FIGS. 6 and 7 illustrate an electronic game 50 embodying the present invention. Game 50 includes a touch screen monitor 52 which is coupled through a control box 54 to a personal computer 56, such as an Apple IIe computer. Monitor 52 may be an AppleColor (TM) Composite Monitor or any black and white monitor compatible with the personal computer being used.

Computer 56 is programmed to move each front side grid square from one to four spaces along either the row or column in which the square lies. Simultaneously, the program moves the squares in the aligned row or column on the back side grid in accordance with the movement on the front side grid. When squares move out of front side grid 28, they wrap around, out of sight, in the same row or columm and change the back side grid. An x-ray or see through view of the back side is selectively provided on the monitor by the program. Movement of the squares is prohibited while the x-ray or see through view is being shown on the monitor. In addition, the program keeps track of the number of moves being made.

Monitor 52 has a cathode ray tube 58 and overlaying the cathode ray tube is a touch screen 60 such as the Elographics Model No. E274 touch screen which translates finger touch to digital coordinates. Touch screen 60 along with its separate Elographics Model No. E271-3 compatible controller circuit housed in control box 54 provides computer 56 with high resolution "x" and "y" coordinates of each point on the screen that is touched by the user in serial data format.

The primary element of the touch screen is a 0.125 inch thick glass plate 62 with an electrically resistant coating 64 on the active side away from tube 58. Coating 64 is uniformly fired onto the glass at a high temperature to provide a stable and durable voltage divider. A mylar contact sheet 66 with a conductive coating 68 on its side that is facing the coated glass plate 62 forms a composite cover sheet 70 that is stretched over the coated glass plate. Cover sheet 70 is held approximately 0.001 inches above resistive coating 64 by small, clear separator points 72 carried by, and evenly distributed over, the interior surface of the cover sheet. Finger pressure upon the outside of cover sheet 70 causes it to deform, as illustrated in broken line in FIG. 7 and make electrical contact with resistive coating 64 at the position of touch. While greatly exaggerated in FIG. 7, the amount of deformation of the contact sheet is imperceptible to the naked eye.

Control box 54 impresses a voltage gradient across resistive coating 64 on glass 62 alternating between the substantially transverse "x" and "y" directions. Voltages picked off by the cover sheet at the point of contact are the analog representation of the position touched. These voltages are digitized by an analog-to-digital converter in control box 54 and the digitized coordinate pair is then transmitted to computer 56 for processing.

Computer software then interprets the touch input and the system responds. Thus, to move a square, the player first touches the square desired to be moved and then touches the position in the row or column on the front side of the grid to which the square is to be moved. Since each square is part of a continuous band, any square moving off the front side grid will go out of sight into the aligned row or column on the back side, and squares in the same continuous band on the back side grid will be brought around to the front side grid.

In addition to an initial display of a front side graphic grid 28 or alphabet grid 44 on monitor 52, a number of machine instruction areas such as "x-ray" and "reset" may be provided on the touch screen. As with effecting movement of the squares forming the front grid, when a user touches the x-ray area 74 of the screen, the program replaces the showing of the front side grid with an x-ray or see through view of the corresponding back side grid 32 or 48. Similarly, when the "reset" area 76 is touched, the computer program will return the puzzle to its initial starting position. Additional touch control areas may be provided for the use of word forming game 40 to instruct the computer when the next player's turn starts and to add the ten forfeit points in the event a player is unable to form a word during the player's turn. A counter display area 78 may also be included for indicating how many moves a player has taken.

Instead of touch screen 60, control of game 50 may be accomplished by player input through a conventional computer keyboard (not shown) or a conventional joystick/button control (not shown) for effecting movement of the squares in any of the up, down, left or right directions. Movement of the joystick would move an indicator such as a blinking light from square to square and initial depression of the button with the indicator on a square would then activate that square for movement. The player would release the button after moving the square to the desired position. Additional buttons would be provided for controlling the x-ray and reset functions as well as the next player and add forfeit points functions for game 40.

Figure 8:
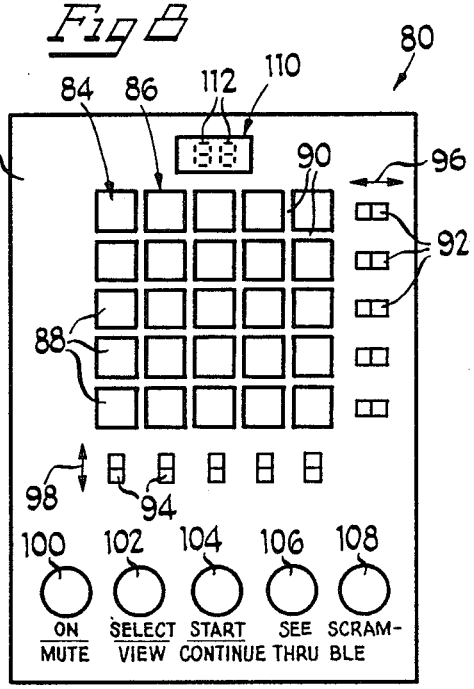
FIG. 8 is a front elevational view of an alternative electronic embodiment.

FIG. 8 shows a self contained electronic embodiment 80 having a housing 82. Contained within the housing is a suitable battery power source (not shown) and a microcontroller (not shown) including read only and random access memories for running the game in a manner similar to that described for game 50. On the front of housing 82 is an LCD 84 divided into a five by five grid 86 of squares 88. Alternatively, LEDs or other light sources could be used for the five by five grid. In addition, a sound chip may be included to provide a fanfare upon the starting and successful completion of a puzzle.

Grid 86 is used to selectively display a front side grid such as graphic squares grid 28 or a see through, x-ray view of back side grid 32. Each square is conveniently one or more pixels and is divided from every other square by a grid mask 90 that may be an intergral part of housing 82 or a overlay attached to the housing. Grid mask 90 may be of any color other than the colors of the squares forming the front and back side grids of the game. The use of multipixel squares 88 creates a visual sense of animation or scrolling movement of the squares in the row or column in which a shift of position is being made. With enough pixels forming each square, alphabet bearing squares 42 and 46 may also be displayed.

To effect a change or shift in position, a touch screen, similar to touch screen 60 described in connection with game 50, may be used. Alternatively, a series of rocker switches or other suitable switches may be used with a switch 92 alongside each row and a switch 94 above or below each column. Movement of a switch 92 to the left or right as indicated by arrow 96 will effect corresponding left or right movement of the squares in the aligned row. Similarly, up or down movement of a switch 94 as indicated by arrow 98 in FIG. 8 will effect movement of the squares in the aligned column.

Below LCD grid 86 are feature control buttons 100, 102, 104, 106 and 108. Above grid 86 is a counter display 110 including two seven segment digits 112. On/-Mute control button 100 powers up game 80 which is preferably made so as to automatically power down after the game has not been used for a preselected amount of time such as three minutes. Game 80 will not totally shut off so that the last played position of the puzzle and any score resident in the RAM memory of the microprocessor will be maintained. After the game is powered up to full power, additional depression of button 100 toggles a sound muting function on or off.

Control button 102 is used to select a particular puzzle to be solved. Conveniently, game 80 has twenty-five different puzzles resident in the microprocessor ROM memory. At the same time that Select/View button 102 is depressed, one of the twenty-five squares 88 is activated by touching it, if a touch screen is used. Alternatively, one of switches 92 or 94 is activated to preselect a square which will be indicated by blinking and then the Select/View button is depressed. The display will then show the front side of the puzzle chosen to be solved. Once a particular puzzle is selected, at any time during the attempted solution of the puzzle, button 102 may be pressed to again see the solution. In order to return to solving the puzzle, Start/Continue button 104 will then have to be pressed.

Initial depression of Start/Continue button 104 will turn the front side grid all white and the back side grid all brown. Simultaneously, the two seven segment digits 112 will show 00. Pressing this button after pushing View button 102 during attempting solution of a puzzle will return the puzzle to the last move made and display the number of moves taken up to that point on counter display 110. See Thru button 106 is a momentary switch enabling the player to see an x-ray view of the back side of the puzzle. When the momentary switch is released, the puzzle returns to its front grid view.

Scramble button 108 is also a momentary switch used for another type of puzzle other than the twenty-five puzzles that may include ones previously described with respect to FIGS. 1A–1E, 2A–2B and 3A–3C. Initial depression of Scramble button 108 causes the LCD front side grid to go all white. The microprocessor then begins to execute sequential random moves pausing between each move and displaying the result on LCD grid 86, until the player releases the Scramble button. Counter display 110 will indicate the number of moves the computer has made and the player then attempts to return the puzzle back to the all white solution in the same number of moves the computer took to scramble it. If Start/Continue button 104 is pushed while working the Scramble puzzle, the LCD grid display would return to the position it was in after the scramble button had been released and the microprocessor had completed its random moves. Depressing Select/View button 102 while working a Scramble puzzle would show the all white solution.

FIGS. 9–12 show a mechanical embodiment 120 of the present invention. Puzzle game 120 includes a central core 122 that is a substantially rectangular solid with square main faces 124 and rectangular edges faces 126. On either of the opposed, substantially parallel, square sides 124 are sixteen support posts 128. Each post 128 is of the same length and spaced an equal distance from each adjacent post lying along a line generally parallel to one of the edges of square face 124.

On each rectangular edge face 126, there are four lateral support posts 130, that are longer or higher than support posts 128, but are otherwise similar, for a total of sixteen lateral support posts 130. One of each of four corner posts 132 extends out from the corner intersection of each rectangular edge face 126 at a forty-five degree angle to the length of posts 130 extending out from each of the intersecting side faces 126. The centers of all of the posts 130 and 132 lie in substantially the same plane.

Attached to the free end of each of the posts 128 is a square part 134. All of the square parts 134 are of substantially the same size and uniform thickness. Each of the parts is attached by a suitable adhesive, ultrasonic welding or the like to its respective posts substantially at the center of the part.

The distance between the center of each post 128 lying along a line generally parallel to one of the edges of square face is greater than the length of a side of square 134 so that there are slots 136 between adjacent squares 134. Slots 136 are of substantially uniform width. Each post 130 is substantially aligned with a row or column of posts 128 on each square face 124 of the core as well as a post 130 extending out from the opposed rectangular side face 126.

A generally U-shaped part 138 is attached to the free end of each post 130 by a suitable adhesive, ultrasonic welding or the like. The width of each U-shaped part is substantially equal to the length of a side of square part 134 and the thickness of each of the spaced apart parallel portions 140 of part 138 is the same as the thickness of square part 134. The distance between the spaced apart parallel portions is such that one portion lies in substantially the same plane as an aligned row or column of square parts 134 on either side of core 122. Bight portion 142 of part 138, however, has a thickness that increases to a maximum at the center of the bight. The free edge of each portion 140 is spaced from an adjacent square part 134 to form a slot 144 that is of the same width as slots 136. Each U-shaped piece 138 is spaced from each adjacent U-shaped piece 138 so as to form a slot 146 that is of the same width and essentially forms a continuation of an aligned band of slots 136.

Onto the free end of each post 132, a corner part 148 is attached by a suitable adhesive, ultrasonic welding or the like. Each corner part has a pair of spaced apart edges 150 that intersect substantially at right angles with another pair of spaced apart edges 150. Between the portions of part 148 forming edges 150 is a curved portion 152 that is of increasing thickness towards its center such that the facing edge of each portion 152 is substantially the same as that of bight portion 142 of U-shaped part 138. Curved corner part 148 is spaced from each adjacent U-shaped part 138 to form slots 156 that are aligned with and are of substantially the same width as slots 136. Thus, it will be appreciated that core 122 with parts 134, 138 and 148 supportedly spaced from the core on posts 128, 130 and 132, respectively, form bands of intersecting slots of substantially the same width.

Mounted for sliding movement in either of two transverse directions on game 120 are ninety movable pieces 160. Each movable piece has a head portion 162 with a substantially flat square top 164 and convex edge faces 166. Top 164 may be conveniently provided with a recess to facilitate applying labels. However, the underside 168 of head 162 is cross vaulted as is best shown in FIG. 12. Accordingly, the bottom of each convex edge face 166 of head portion 162 is concave. At the center of the intersecting barrel vaults forming the cross vault, there is a bifurcated body portion or slit stem 170 with a truncated conical foot portion 172 forming a generally flat flange 174 that is bifurcated by slit 176.

Stem or body portion 170 is generally cylindrical and of a diameter slightly less than the width of slots 136, 144, 146 and 156. Stem 170 is sufficiently resilient so that the two split branches may be forced together about slit 176 to force conical foot portion 172 through a slot. After insertion, the split branches return to the spaced apart condition and pieces 160 are retained against removal while being slidable in the bands of slots. Accordingly, with each movable piece 160 carried with head 162 above and foot portion 172 below parts 134, 138 and 148 and with stem or body portion 170 in one of slots 136, 144, 146 or 156, each movable piece is carried for sliding movement in either one of two continuous intersecting bands.

When a movable piece 160 is in either the front side five by five grid 178 or the back side five by five grid 180, generally flat flange 174 engages the underside of part 134 and the spaced apart parallel portions 140 of U-shaped part 138 while the bottom edges of convex edge faces 168 engage the exposed sides of parts 134 and portions 140. However, when movable piece 160 is moved out of one of the five by five grids onto the curved end portions of game 120, then, as is best illustrated in FIG. 10, the cross vaulted underside of head 162 engages the outer curved surface of bight portion 142 of U-shaped part 138 and the outer side of curved portion 152 of corner part 148. Only the edges of flange 174 contact the inner sides of curved portions 142 and 152. The increasing thickness of the curved portions of parts 138 and 148 toward their respective centers fits into the underside vaults of head 162. Hence, as best illustrated in FIG. 10, there is virtually no gap between adjacent pieces 60 as they wrap around the curved ends of game 120.

Because of the ten movable pieces that remain on each curved end of game 120, there are an additional forty movable pieces beside the fifty pieces forming the two five by five grids. When the movable pieces or squares are moved out of the front side five by five grid, they wrap around, out of sight, initially onto the curved ends and onto the grid on the back side. Hence, with sixty-five out of sight pieces, solving puzzles with game 120 may be more difficult than with the electronic embodiments. Of course, while it is not possible with this mechanical version to have an actual x-ray or see through view of the back side, the entire puzzle game may be turned over to see the back side.

While particular embodiments of the present invention have been shown and described with some changes and modifications, additional changes and modifications will occur to those skilled in the art. It is intended in the appended claims to cover all such changes and modifications as fall within the true spirit and scope of the present invention.

What is claimed as new and desired to be secured by Letters Patent is:

1. A puzzle comprising:
a front side;
a back side;
a total number of movable squares;
a grid on the front side of the puzzle initially formed by some of the total number of movable squares;
a grid on the back side of the puzzle initially formed by some of the total number of movable squares;
each square being part of each of two mutually transverse, continuous bands of squares;
aligned rows on the front side and on the back side formed by one of the two bands;
aligned columns on the front side and on the back side formed by the other transverse band;
means for changing the relationship of each square in either the front side grid or the back side grid with respect to every other square in the front side and back side grids;
means for distinguishing the movable squares initially forming the front side grid from the movable squares initially forming the back side grid; and
means for electronically displaying one of the grids and selectively displaying the other of the grids to the exclusion of the one grid.

2. A puzzle comprising:
a front side;
a back side;
a total number of movable squares;
a grid on the front side of the puzzle initially formed by some of the total number of movable squares;
a grid on the back side of the puzzle initially formed by some of the total number of movable squares;
each square being part of each of two mutually transverse, continuous bands of squares;
aligned rows on the front side and on the back side formed by one of the two bands;
aligned columns on the front side and on the back side formed by the other transverse band;
means for changing the relationship of each square in either the front side grid or the back side grid with respect to every other square in the front side and back side grids;
means for distinguishing the movable squares initially forming the front side grid from the movable squares initially forming the back side grid;
means for electronically displaying one of the grids, and
means for effecting movement of a square by touching the electronically displayed grid.

3. The puzzle of claim 2 including means for selectively displaying the other of the grids to the exclusion of the one grid.

4. The puzzle of claim 3 including means precluding the use of the means for effecting movement of a square during the selective display of the other of the grids.

5. A puzzle comprising:
a front side;
a back side;
a total number of movable squares;
a grid on the front side of the puzzle initially formed by some of the total number of movable squares;
a grid on the back side of the puzzle initially formed by some of the total number of movable squares;

each square being part of each of two mutually transverse, continuous bands of squares;

aligned rows on the front side and on the back side formed by one of the two bands;

aligned columns on the front side and on the back side formed by the other transverse band;

means for changing the relationship of each square in either the front side grid or the back side grid with respect to every other square in the front side and back side grids;

means for distinguishing the movable squares initially forming the front side grid from the movable squares initially forming the back side grid;

means for electronically displaying one of the grids;

means for storing solutions to the puzzle in memory; and means for selecting a solution for display by the means for electronically displaying the one grid.

6. A puzzle comprising:

a front side;

a back side;

a total number of movable squares;

a grid on the front side of the puzzle initially formed by some of the total number of movable squares;

a grid on the back side of the puzzle initially formed by some of the total number of movable squares;

each square being part of each of two mutually transverse, continuous bands of squares;

aligned rows on the front side and on the back side formed by one of the two bands;

aligned columns on the front side and on the back side formed by the other transverse band;

means for changing the relationship of each square in either the front side grid or the back side grid with respect to every other square in the front side and back side grids;

means for distinguishing the movable squares initially forming the front side grid from the movable squares initially forming the back side grid;

a central core;

a plurality of posts extending from the central core;

a part supported on each post spaced from the core and spaced from every other part an equal distance to define a first set of spaced part, generally parallel continuous bands of slots and a second set of spaced apart, generally parallel continuous bands of slots that are generally transverse to the first set;

means for mounting each of the squares forming the grids on the front side and the back for movement along either of two mutually transverse intersecting continuous bands of slots;

curved ends between the front side and the back side;

one set of continuous bands of slots extending through each of the curved ends;

the squares having depending stems that extend through the slots;

means carried adjacent the end of the stem spaced from the square for engaging the underside of the parts; and the underside of each square being cross vaulted.

7. A method of generating an electronic game display and controlling the play of the game on an electronic display in response to player operation comprising the steps of:

generating an electronic display of a front side grid of squares each lying in one of two mutually transverse, continuous bands;

maintaining in memory a view of a back side grid of squares lying in the same continuous bands; and adjusting the electronic display in response to player operation to reposition the squares.

8. The method of claim 7 including the step of distinguishing the squares initially forming the front side grid from the squares initially forming the back side grid.

9. The method of claim 8 including the step of storing the puzzle solutions in memory.

10. The method of claim 8 including the step of selectively generating an electronic display of the back side grid to the exclusion of the electronic display of the front side grid.

* * * * *